US010705445B2

(12) United States Patent
Nakano

(10) Patent No.: US 10,705,445 B2
(45) Date of Patent: Jul. 7, 2020

(54) DATA PROCESSING DEVICE AND IMAGE FORMING APPARATUS

(71) Applicant: KYOCERA Document Solutions Inc., Osaka-shi, Osaka (JP)

(72) Inventor: Ayumi Nakano, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/702,370

(22) Filed: Dec. 3, 2019

(65) Prior Publication Data

US 2020/0174392 A1 Jun. 4, 2020

(30) Foreign Application Priority Data

Dec. 4, 2018 (JP) ..... 2018-227163

(51) Int. Cl.
*G03G 15/01* (2006.01)

(52) U.S. Cl.
CPC ..... *G03G 15/0131* (2013.01)

(58) Field of Classification Search
CPC ..... G03G 15/0131; G03G 15/5054
See application file for complete search history.

(56) References Cited

U.S. PATENT DOCUMENTS 8,380,093 B2 * 2/2013 Shukuya ..... G03G 15/0131 399/39
2013/0259542 A1 * 10/2013 Aviv ..... G03G 15/0131 399/301
2015/0277270 A1 * 10/2015 Hasegawa ..... G03G 15/043 347/118

FOREIGN PATENT DOCUMENTS

JP 2002139880 A 5/2002

* cited by examiner

*Primary Examiner* — Gregory H Curran
(74) *Attorney, Agent, or Firm* — Alleman Hall Creasman & Tuttle LLP

(57) ABSTRACT

First acquisition processing portion acquires first position and second position in main scanning direction. Second acquisition processing portion acquires, from third specific area having second specific length in sub scanning direction on color image, a plurality of third positions of a plurality of pixels of first color in main scanning direction, second specific length being larger than first specific length that is length in peripheral direction of each of image carriers. First derivation processing portion, based on plurality of third positions, derives first color shift amount that indicates an amount of shifting of pixels of first color in main scanning direction in third specific area. Second derivation processing portion, based on first position, second position, and first color shift amount, derives second color shift amount that indicates an amount of shifting between first color and second color in main scanning direction in first specific area.

6 Claims, 15 Drawing Sheets

DATA PROCESSING DEVICE AND IMAGE FORMING APPARATUS

INCORPORATION BY REFERENCE

This application is based upon and claims the benefit of priority from the corresponding Japanese Patent Application No. 2018-227163 filed on Dec. 4, 2018, the entire contents of which are incorporated herein by reference.

BACKGROUND

The present disclosure relates to a data processing device and an image forming apparatus of a tandem type.

In an image forming apparatus of a tandem type, an exposure device forms a plurality of electrostatic latent images for a plurality of colors on a plurality of image carriers that rotate with a predetermined period. The plurality of electrostatic latent images are developed as a plurality of toner images on the plurality of image carriers. The plurality of toner images are overlaid on an intermediate transfer belt. This allows a color image to be formed.

The distance between the image carrier and the exposure device may vary during the period (hereinafter referred to as a "rotation period") with which the image carrier rotates. In addition, the variation of the distance during the rotation period may differ among the plurality of image carriers. As a result, in the image forming apparatus, the plurality of toner images of the plurality of colors may be overlaid on the intermediate transfer belt in a state of being shifted from each other in a main scanning direction.

In the image forming apparatus, a specific color image for a shift inspection is formed on the intermediate transfer belt before the image formation. The specific color image includes a plurality of specific patterns of the plurality of colors that are aligned in a sub scanning direction. For example, as a related technology, there is known an image forming apparatus that derives shift amounts in the main scanning direction of the plurality of specific patterns of the plurality of colors, based on specific image data that is obtained by optically reading the specific color image.

SUMMARY

A data processing device according to an aspect of the present disclosure includes a first acquisition processing portion, a second acquisition processing portion, a first derivation processing portion, and a second derivation processing portion. The first acquisition processing portion acquires, respectively from a first specific area and a second specific area that align in a sub scanning direction on a color image that is formed based on image data, a first position and a second position in a main scanning direction, the first position and the second position being respectively positions of pixels of a first color and a second color formed on a plurality of image carriers that rotate. The second acquisition processing portion acquires, from a third specific area having a second specific length in the sub scanning direction on the color image, a plurality of third positions of a plurality of pixels of the first color in the main scanning direction, the second specific length being larger than a first specific length that is a length in a peripheral direction of each of the image carriers. The first derivation processing portion, based on the plurality of third positions, derives a first color shift amount that indicates an amount of shifting of pixels of the first color in the main scanning direction in the third specific area. The second derivation processing portion, based on the first position, the second position, and the first color shift amount, derives a second color shift amount that indicates an amount of shifting between the first color and the second color in the main scanning direction in the first specific area.

An image forming apparatus according to another aspect of the present disclosure includes the data processing device, and an image forming portion configured to form an image on a sheet.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings for the understanding of the present disclosure. It should be noted that the following embodiment is an example of a specific embodiment of the present disclosure and should not limit the technical scope of the present disclosure.

Figure 1:
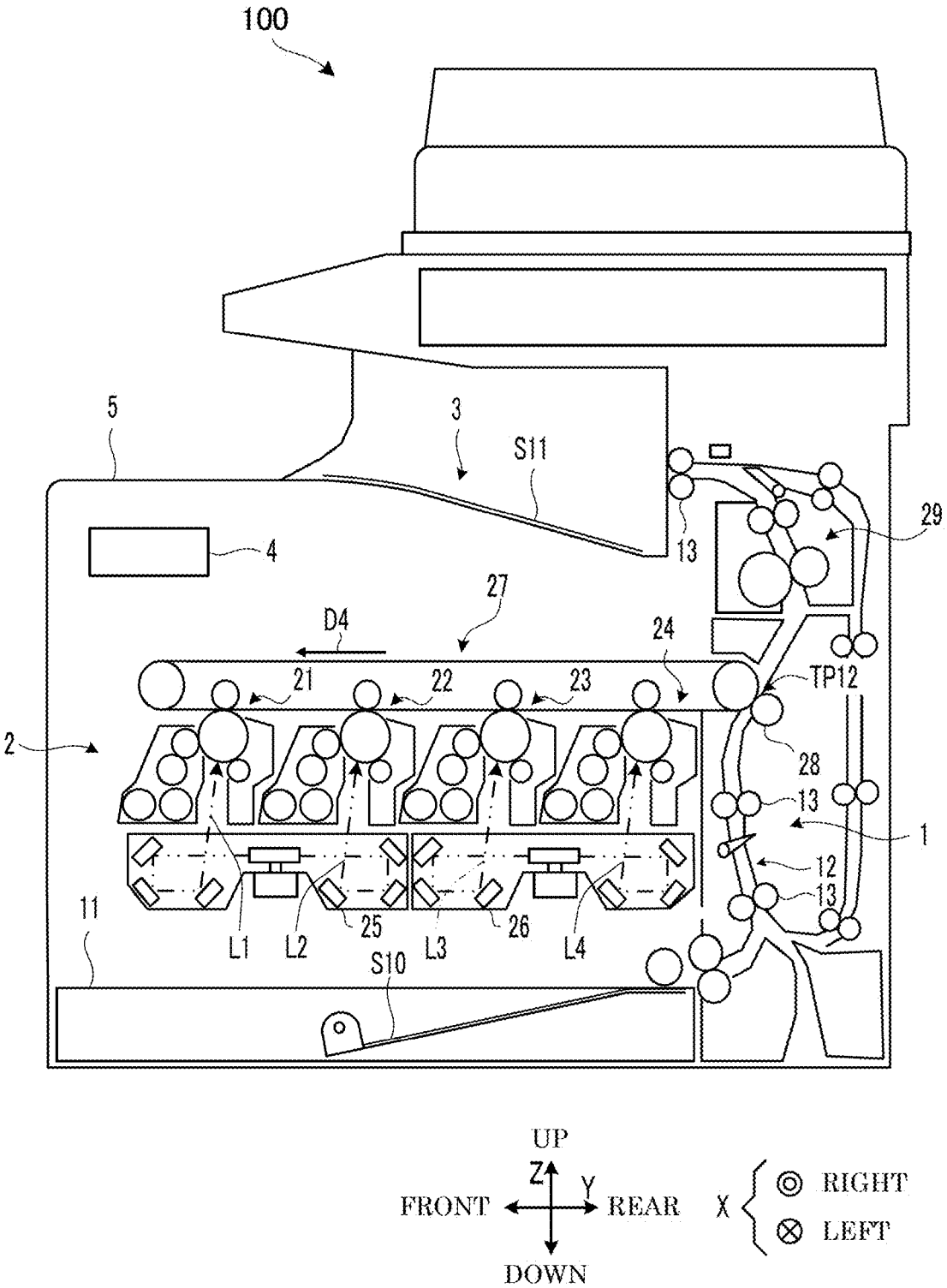
FIG. 1 is a schematic diagram showing a configuration of an image forming apparatus according to an embodiment of the present disclosure.
Figure 2:
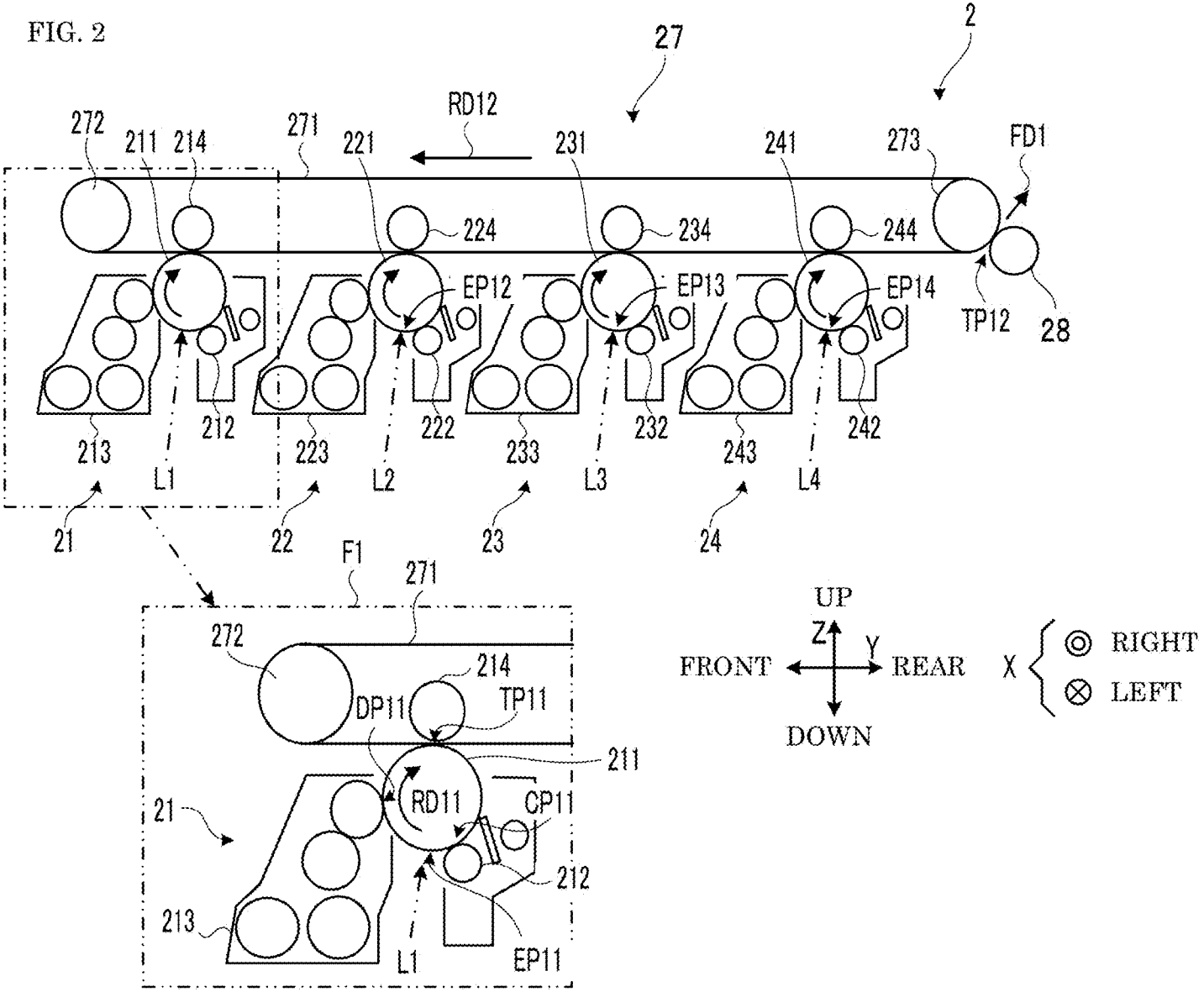
FIG. 2 is a schematic diagram showing a detailed configuration of an image forming portion shown in FIG. 1.

In FIG. 1 and FIG. 2, the arrows X, Y, and Z respectively indicate the left-right direction, the front-rear direction, and the up-down direction of an image forming apparatus 100.

Referring to FIG. 1, the image forming apparatus 100 is a printer, a facsimile, a copier, or a multifunction peripheral. The multifunction peripheral has a plurality of functions such as a print function, a facsimile function, and a copy function. The image forming apparatus 100 includes a sheet feed portion 1, an image forming portion 2, a sheet discharge portion 3, and a control portion 4.

The sheet feed portion 1 includes a storage portion 11, a conveyance path 12, and a plurality of pairs of rollers 13. The storage portion 11 is a cassette, a tray or the like, and is provided at a lower portion of a housing 5 of the image forming apparatus 100. Unprinted sheets (paper sheets or the like) S10 are stored in the storage portion 11. The conveyance path 12 passes a position close to a rear end of the housing 5 and extends from the storage portion 11 to the sheet discharge portion 3. The sheet discharge portion 3 is sheet discharge tray or the like provided at an upper portion of the housing 5. The plurality of pairs of rollers 13 are provided at a plurality of positions in the conveyance path 12, and are configured to convey a sheet S10 from the storage portion 11 to the sheet discharge portion 3.

The image forming portion 2 is of a tandem type, and forms an image based on an electrophotographic method. The image forming portion 2 is provided between the storage portion 11 and the sheet discharge portion 3 in the housing 5. The image forming portion 2 forms an image based on image data, and transfers the image to the sheet S10 at a secondary transfer position TP12 on the conveyance path 12. The image forming portion 2 further fixes the image onto the sheet S10, and feeds the sheet S10 as a print S11 toward the downstream of the conveyance path 12.

The control portion 4 includes: a processor that is a CPU or the like; a program storage portion that is a ROM or the like; and a working area that is a RAM or the like. The processor executes programs that are preliminarily stored in the program storage portion, by using the working area. This allows the control portion 4 to control the components of the image forming apparatus 100 comprehensively. It is noted that the control portion 4 may be an electronic circuit such as an ASIC (Application Specific Integrated Circuit) or a DSP (Digital Signal Processor).

Next, a detailed configuration of the image forming portion 2 is described. As shown in FIG. 1, the image forming portion 2 includes four image forming units 21, 22, 23, and 24, two laser scanning units (hereinafter referred to as LSUs) 25 and 26, an intermediate transfer unit 27, a secondary transfer portion 28, and a fixing portion 29.

The image forming units 21 to 24 are disposed at the same position in the up-down direction and the left-right direction. The image forming units 21 to 24 are arranged in alignment at equal intervals in an order of 21, 22, 23, and 24 from the front side toward the rear side. It is noted that not limited to four image forming units, the image forming portion 2 may include a plurality of image forming units.

The image forming units 21, 22, 23, and 24 are provided respectively for colors of yellow, magenta, cyan, and black. As shown in FIG. 2, the image forming unit 21 includes an image carrier 211, a charging portion 212, a developing portion 213, and a primary transfer portion 214.

The image carrier 211 is, for example, a photoconductor drum of a cylindrical shape. The image carrier 211 extends in the left-right direction in the housing 5, and supported by the housing 5 in such a way as to rotate in a rotation direction RD11 (see inside the frame F1 of FIG. 2). The image carrier 211 rotates with a predetermined period (hereinafter referred to as a rotation period).

The charging portion 212 is, for example, a charging roller, and extends in the left-right direction at a charging position CP11 (see inside the frame F1 of FIG. 2) near a bottom end of the image carrier 211. The charging portion 212 uniformly charges the peripheral surface of the image carrier 211.

The peripheral surface of the image carrier 211 is scanned by light L1 at an exposure position EP11 (see inside the frame F1 of FIG. 2). This allows an electrostatic latent image for yellow to be formed on the peripheral surface of the image carrier 211. The exposure position EP11 is on the downstream of the charging position CP11 in the rotation direction RD11. The light L1 is light that has been modified based on the image data, and is emitted from the LSU 25 (see FIG. 1).

The developing portion 213 extends along the peripheral surface of the image carrier 211 at a developing position DP11 (see inside the frame F1 of FIG. 2). The developing position DP11 is on the downstream of the exposure position EP11 in the rotation direction RD11. The developing portion 213 supplies yellow toner to the developing position DP11. This allows a yellow toner image to be formed on the peripheral surface of the image carrier 211.

The primary transfer portion 214 extends in the left-right direction at a position separated upward from a primary transfer position TP11 (see inside the frame F1 of FIG. 2) on the peripheral surface of the image carrier 211. Specifically, the primary transfer position TP11 is on the downstream of the developing position DP11 in the rotation direction RD11, and is the top position of the image carrier 211. An intermediate transfer belt 271 intervenes between the primary transfer portion 214 and the image carrier 211. The primary transfer portion 214 transfers the toner image formed on the image carrier 211, to the intermediate transfer belt 271.

The image forming unit 22 includes an image carrier 221, a charging portion 222, a developing portion 223, and a primary transfer portion 224. The image forming unit 23 includes an image carrier 231, a charging portion 232, a developing portion 233, and a primary transfer portion 234. The image forming unit 24 includes an image carrier 241, a charging portion 242, a developing portion 243, and a primary transfer portion 244. The image forming units 22, 23, and 24 differ from the image forming unit 21 in that (1) they are arranged at different positions in the front-rear direction, (2) the image carriers 221, 231, and 241 are scanned by lights L2, L3, and L4 at exposure positions EP12, EP13, and EP14, respectively, and (3) they form magenta, cyan, and black toner images. As a result, a detailed description of the image forming units 22 to 24 is omitted.

Referring to FIG. 1, the LSU 25 scans the exposure positions EP11 and EP12 with lights L1 and L2, respectively. The LSU 26 scans the exposure positions EP13 and EP14 with lights L3 and L4, respectively.

As shown in FIG. 2, the intermediate transfer unit 27 includes an intermediate transfer belt 271, a driving roller 272, and a driven roller 273.

The driving roller 272 and the driven roller 273 are arranged to be higher than the image carriers 211 to 241 and separated from each other in the front-rear direction in the housing 5 (see FIG. 1). The driving roller 272 and the driven roller 273 extend in the left-right direction and are supported by the housing 5 in such a way as to rotate around axes that extend in the left-right direction. The intermediate transfer belt 271 is an endless belt, and is stretched between the driving roller 272 and the driven roller 273. The intermediate transfer belt 271 rotates in a rotation direction RD12 when the driving roller 272 rotates. During the rotation of the intermediate transfer belt 271, toner images of the four colors formed on the image carriers 211, 221, 231, and 241 are overlaid on the outer peripheral surface of the intermediate transfer belt 271. This allows a color image to be formed on the outer peripheral surface. The intermediate transfer belt 271 carries and conveys the color image to the secondary transfer position TP12. The secondary transfer position TP12 is on the downstream of the primary transfer position TP11 in the rotation direction RD12, and the intermediate transfer belt 271 and the secondary transfer portion 28 face each other at the secondary transfer position TP12.

The secondary transfer portion 28 is, for example, a secondary transfer roller. The secondary transfer portion 28 extends in the left-right direction at the secondary transfer position TP12, and faces the driven roller 273 across the intermediate transfer belt 271. At the secondary transfer position TP12, the sheet S10 is conveyed diagonally upward in a conveyance direction FD1. In addition, at the secondary transfer position TP12, the secondary transfer portion 28 transfers the color image carried by the intermediate transfer belt 271, to the sheet S10 (see FIG. 1).

Referring to FIG. 1, the fixing portion 29 is provided on the downstream of the secondary transfer position TP12 in the conveyance path 12. The fixing portion 29 includes a fixing roller and a pressure roller, and applies heat and pressure to the toner on the sheet S10 output from the secondary transfer portion 28. This allows the color image to be fixed to the sheet S10. The fixing portion 29 feeds, as the print S11, the sheet S10 with the color image fixed thereto toward the downstream in the conveyance path 12.

Figure 3A:
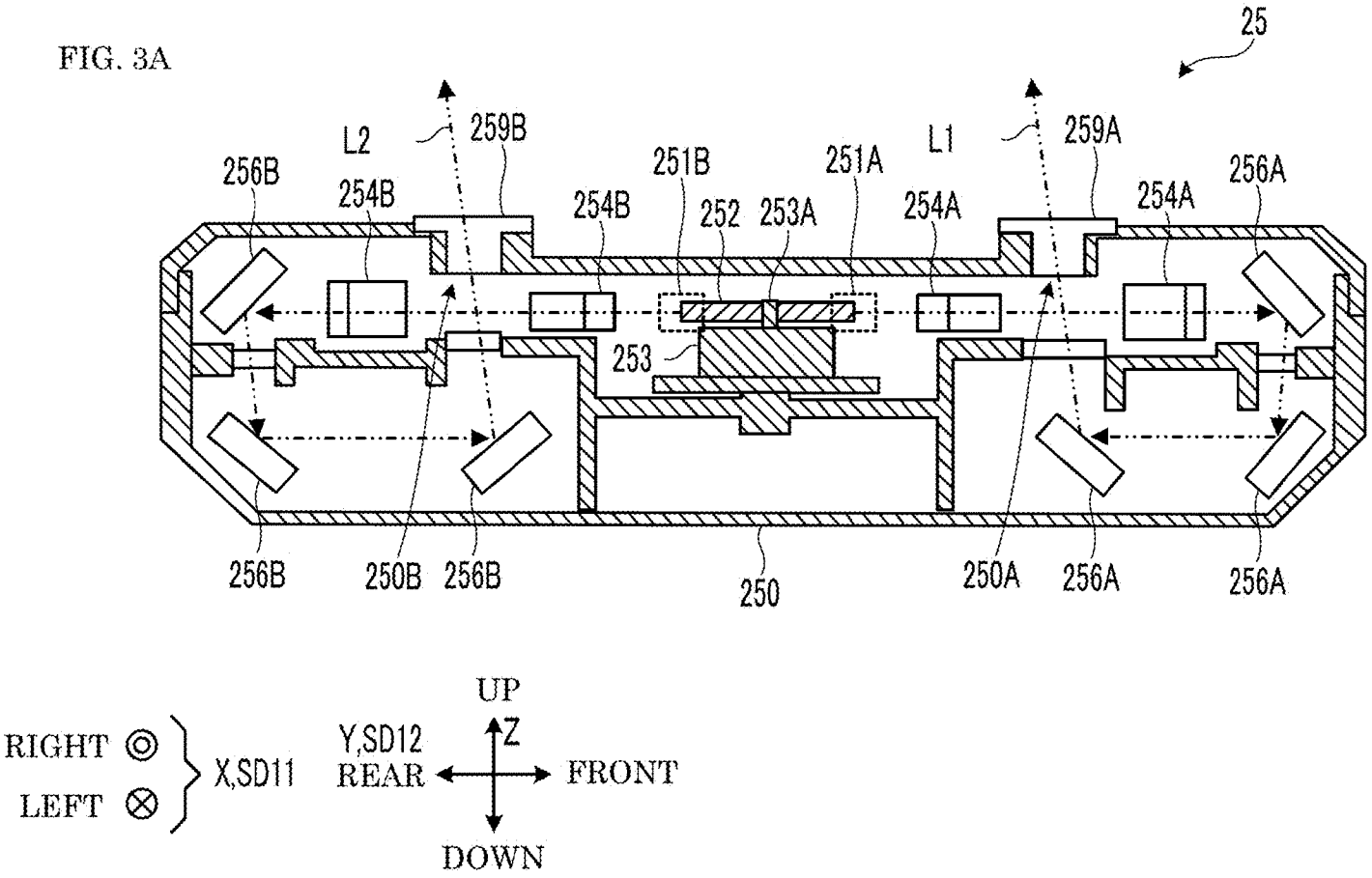
FIG. 3A is a schematic diagram showing a detailed configuration of a LSU shown in FIG. 1.

Next, a detailed configuration of the LSU 25 is described. As shown in FIG. 3A, the LSU 25 includes a housing 250, two light sources 251A and 251B, a polygon mirror 252, and a polygon motor 253. The LSU 25 further includes, in correspondence with the light source 251A, two fθ lenses 254A, three reflection mirrors 256A, and a translucent member 259A. The LSU 25 further includes, in correspondence with the light source 251B, two fθ lenses 254B, three reflection mirrors 256B, and a translucent member 259B.

The light sources 251A and 251B are, for example, laser diodes. The light sources 251A and 251B are arranged to be separated from each other in the front-rear direction in the housing 250. In the housing 250, the light sources 251A and 251B emit lights that have been modified based on the image data, toward the polygon mirror 252 that is provided on the left side of the light sources 251A and 251B.

The polygon mirror 252 is polygonal in a plan view viewed in the up-down direction, and has a plurality of deflection surfaces. Upon receiving a rotational driving force supplied from the polygon motor 253, the polygon mirror 252 rotates around a rotation shaft 253A that extends in the up-down direction. Rotating in this way, the polygon mirror 252 deflects, frontward and rearward in sequence, lights that are incident on the plurality of deflection surfaces from the light sources 251A and 251B so as to scan the lights in a main scanning direction SD11 at an equal angular velocity.

Specifically, the main scanning direction SD11 is the left-right direction. In addition, in the following, a direction perpendicular to the main scanning direction SD11 is referred to as a sub scanning direction SD12. The sub scanning direction SD12 is opposite to the rotation direction RD11 (see FIG. 2). In addition, the sub scanning direction SD12 is opposite to the conveyance direction FD1 of the sheet S10, and the main scanning direction SD11 is perpendicular to the conveyance direction FD1 of the sheet S10 (see FIG. 5).

The two fθ lenses 254A are provided in the housing 250, and convert a light that has been deflected by the polygon mirror 252 to travel frontward, to a light that scans at the exposure position EP11 (see FIG. 2) in the main scanning direction SD11 at an equal speed. The three reflection mirrors 256A guide a light that has passed through the two fθ lenses 254A to the translucent member 259A.

The two fθ lenses 254B are provided in the housing 250, and convert a light that has been deflected by the polygon mirror 252 to travel rearward, to a light that scans at the exposure position EP12 (see FIG. 2) in the main scanning direction SD11 at an equal speed. The three reflection mirrors 256B guide a light that has passed through the two fθ lenses 254B to the translucent member 259B.

Figure 3B:
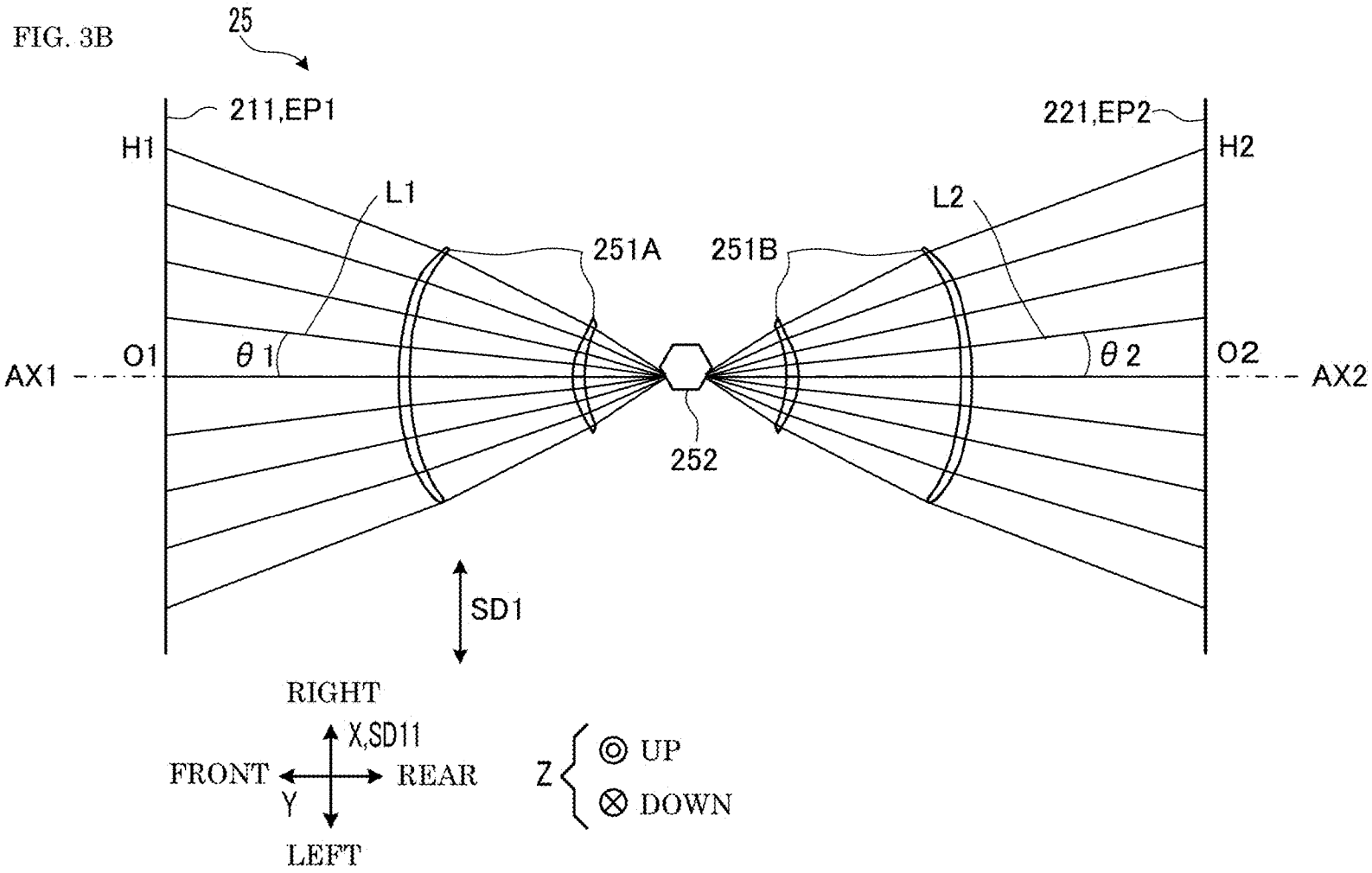
FIG. 3B is a schematic diagram of the LSU and an image carrier shown in FIG. 1 viewed from above.

Slits 250A and 250B that are elongated in the main scanning direction SD11 are formed in alignment at an interval in the front-rear direction on a top surface of the housing 250. The translucent members 259A and 259B are plate-shaped members formed from a translucent material, and respectively shield the slits 250A and 250B. The lights guided to the translucent members 259A and 259B respectively scan, as the lights L1 and L2, at the exposure positions EP11 and EP12 (see FIG. 2) in the main scanning direction SD11, and are imaged. As shown in FIG. 3B, positions (namely, image heights) H in the main scanning direction SD11 at which the lights L1 and L2 are imaged, correspond to deflection angles θ1 and θ2. The deflection angles θ1 and θ2 are formed by an optical axis AX1 of the two fθ lenses 254A and the two fθ lenses 254B and the lights L1 and L2, and vary with the rotation of the polygon mirror 252. For the image heights H, intersections between the optical axis AX1 and peripheral surfaces of the image carriers 211 and 221 are origins O.

As shown in FIG. 1, the LSU 26 differs from the LSU 25 in that (1) it is arranged at a different position in the front-rear direction in the housing 5, and (2) it scans lights L3 and L4 that have been deflected by the polygon mirror at deflection angles θ3 and θ4, at exposure positions EP13 and EP14 (see FIG. 2) in the main scanning direction SD11. As a result, a detailed description of the LSU 26 is omitted.

The distance between the image carrier 211 and the LSU 25 may vary during the rotation period of the image carrier 211 even if a reflection angle of a reflection mirror 256A that is closest to the translucent member 259A on the optical path, is constant. The distance variation during the rotation period may be generated due to a rotational deviation of the image carrier 211. The distance between the image carrier 221 and the LSU 25, and the distance between the image carriers 231, 241 and the LSU 26 may vary, as well. In addition, the distance variation during the rotation period (hereinafter merely referred to as a "distance variation") may be different among the plurality of image carriers 211, 221, 231, and 241. As a result, in the image forming apparatus 100, the toner images of the four colors may be shifted from each other when they are overlaid on the peripheral surface of the intermediate transfer belt 271.

Meanwhile, according to the image forming apparatus of the above-described related technology, a specific color image for a shift inspection is formed on the intermediate transfer belt before an image formation. The specific color image includes specific patterns of the plurality of colors that align in the sub scanning direction. In the image forming apparatus, an amount of shifting in the main scanning direction is derived for each of the specific patterns of the plurality of colors based on specific image data that is obtained by optically reading the specific color image, and the shift is corrected.

In a case where the length of the specific patterns in the sub scanning direction is shorter than a length corresponding to the rotation period, the specific image data may not include an amount of variation of the distance during the whole rotation period. As a result, during an image formation after a correction of the shift amount derived based on the specific patterns, when the toner images of the plurality of colors are overlaid on the intermediate transfer belt, a shift in the main scanning direction may occur between the toner images of the plurality of colors.

On the other hand, a data processing device 200 according to the present embodiment is configured to derive an amount of shifting so as to reduce the color shift of the plurality of toner images when the toner images of the plurality of colors are overlaid with each other in the image forming apparatus 100 of the tandem type.

Figure 4:
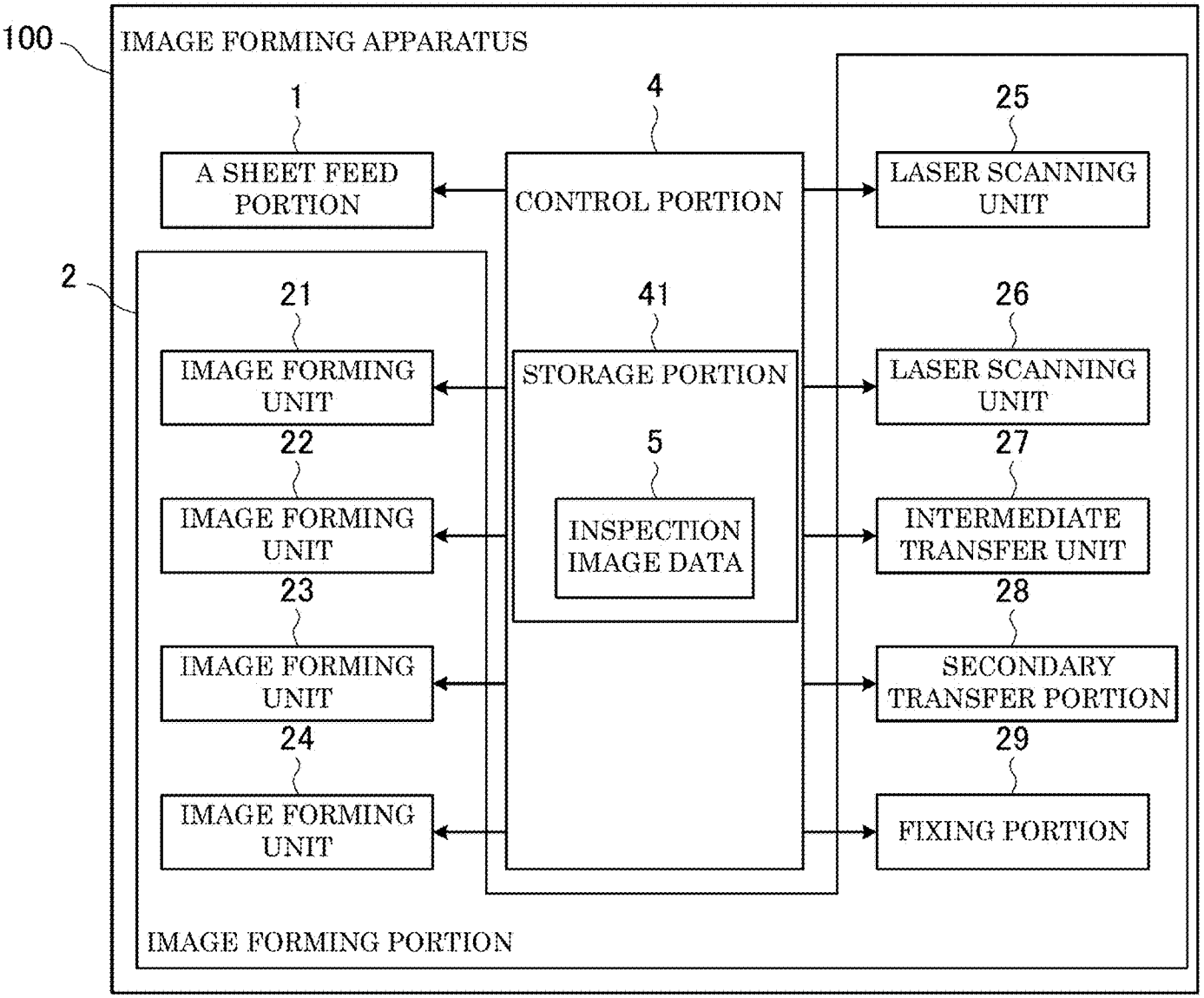
FIG. 4 is a block diagram showing a configuration of the image forming apparatus shown in FIG. 1.

Referring to FIG. 4, the control portion 4 further includes a storage portion 41. The storage portion 41 is a nonvolatile storage device. The storage portion 41 preliminarily stores inspection image data (hereinafter merely referred to as "image data") 5.

The image data 5 represents a specific color image 50 for the shift inspection, and is generated on a supposition that the rotational deviation does not occur to the image carriers 211, 221, 231, and 241 (see FIG. 2). The image forming apparatus 100 executes an image formation based on the image data 5 in an adjustment process before the shipment from the factory. The specific color image 50 (see FIG. 5) is formed on a print (hereinafter referred to as a "specific print") S11 that is obtained by the image formation. The specific color image 50 is an example of a color image of the present disclosure.

Figure 5:
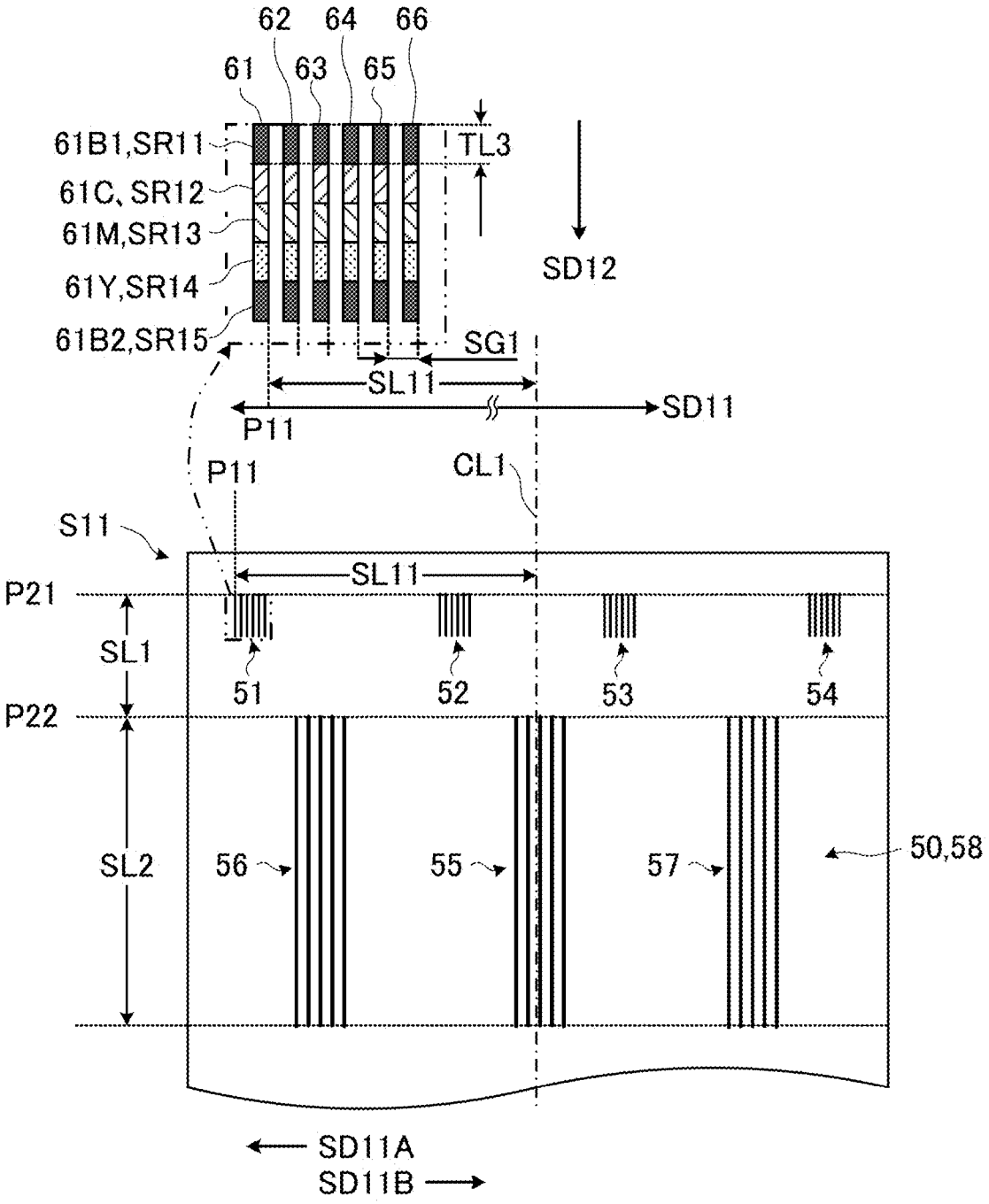
FIG. 5 is a schematic diagram showing a specific color image represented by inspection image data shown in FIG. 4.

As shown in FIG. 5, the specific color image 50 includes four first inspection images 51 to 54, a reference image 55, and two second inspection images 56 and 57.

The first inspection image 51 includes six line images 61 to 66. The line image 61 includes a black image 61B1, a cyan image 61C, a magenta image 61M, a yellow image 61Y, and a black image 61B2. The black images 61B1 and 61B2 are line images of a single color of black, and are formed in specific areas SR11 and SR15. The cyan image 61C, the magenta image 61M, and the yellow image 61Y are respectively line images of a single color of cyan, a single color of magenta, and a single color of yellow, and are formed in specific areas SR12, SR13, and SR14.

The specific areas SR11 to SR15 each have a linear shape elongated in the sub scanning direction SD12. The specific areas SR11 to SR15 are arranged in alignment in an order of SR11, SR12, SR13, SR14, and SR15 in the sub scanning direction SD12 at the first position P11 in the main scanning direction SD11. The position P11 is separated from a center line CL1 by a specific distance SL11 in a separation direction SD11A. The center line CL1 extends in the sub scanning direction SD12 and passes through the center of the specific print S11 in the main scanning direction SD11. The separation direction SD11A is a direction separating from the center line CL1 in the main scanning direction SD11. In a case where the rotational deviation does not occur to the image carriers 211, 221, 231, and 241 (see FIG. 2) (hereinafter the case is referred to as an "ideal state"), the specific areas SR11 to SR15 are at the same position in the main scanning direction SD11, but, on the specific print S11, the specific areas SR11 to SR15 may be shifted from each other in the main scanning direction SD11.

Here, a first specific length SL1 refers to a length in the main scanning direction SD11 that corresponds to the rotation period. In other words, the first specific length SL1 is a length of the peripheral surface of each of the image carriers 211, 221, 231, and 241 in the rotation direction RD11. A length TL3 that is a length of each of the specific areas SR11 to SR15 in the sub scanning direction SD12 is shorter than the first specific length SL1.

In the ideal state, the line images 62, 63, 64, 65, and 66 are the line images 61, 62, 63, 64, and 65 that have been moved in parallel by a specific interval SG1 in an approaching direction SD11B that is a direction approaching the center line CL1 in the main scanning direction SD11.

The first inspection image 52 is formed between the first inspection image 51 and the center line CL1 on the specific print S11. In the ideal state, the first inspection image 52 is the first inspection image 51 that has been moved in parallel in the approaching direction SD11B. In the ideal state, the first inspection images 53 and 54 are respectively symmetric with the first inspection images 52 and 51 with respect to the center line CL1.

The reference image 55 and the second inspection image 56 are separated from a position P21 in the sub scanning direction SD12 by the first specific length SL1. The position P21 is a position of an end of each of the first inspection images 51 to 54 on the upstream side in the sub scanning direction SD12. In the ideal state, the reference image 55 and the second inspection image 56 extend from a position P22 by a second specific length SL2 that is larger than the first specific length SL1, in the sub scanning direction SD12. The position P22 is separated from the position P21 by the first specific length SL1 in the sub scanning direction SD12.

Figure 6:
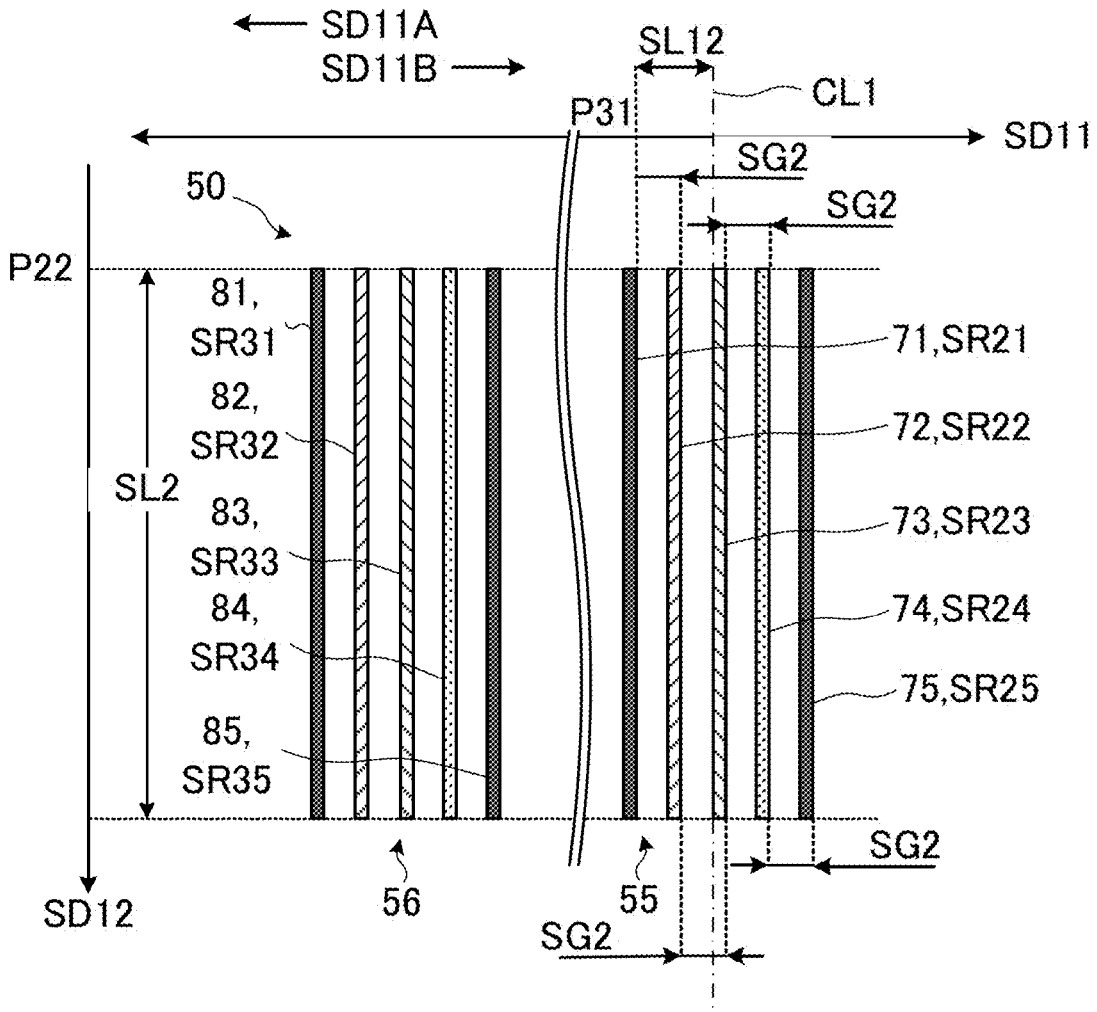
FIG. 6 is a schematic diagram showing a reference image and a second inspection image shown in FIG. 5.

Specifically, as shown in FIG. 6, the reference image 55 includes five line images 71 to 75. The line images 71 and 75 are black solid images respectively formed in specific areas SR21 and SR25. The line images 72, 73, and 74 are cyan, magenta, and yellow solid images respectively formed in specific areas SR22, 23, and 24 that are an example of a fifth specific area of the present disclosure.

Each of the specific areas SR21 to SR25 has a linear shape, and in the ideal state, extends from the position P22 by the second specific length SL2 in the sub scanning direction SD12. The specific areas SR21 to SR25 are closer to the center line CL1 than specific areas SR31 to SR35, and extend in the sub scanning direction SD12 at a position between the first inspection images 52 and 53 (see FIG. 5) in the main scanning direction SD11. The specific area SR21 extends in the sub scanning direction SD12 at a position P31 that is separated from the center line CL1 by a specific length SL12. The specific areas SR22, SR23, SR24, and SR25 align with a specific interval SG2 from the specific areas SR21, SR22, SR23, and SR24 in the main scanning direction SD11. However, the specific areas SR21 to SR25 are not parallel to the sub scanning direction SD12, but wave due to the distance variation.

As shown in FIG. 5, the second inspection image 56 is located between the first inspection images 51 and 52 in the main scanning direction SD11. As shown in FIG. 6, the second inspection image 56 includes five line images 81 to 85. The line images 81 and 85 are black solid images respectively formed in specific areas SR31 and SR35 that are an example of a fourth specific area of the present disclosure. The line images 82, 83, and 84 are cyan, magenta, and yellow solid images respectively formed in specific areas SR32, SR33, and SR34 that are an example of a third specific area of the present disclosure. In the ideal state, the specific areas SR31 to SR35 are specific areas SR21 to SR25 moved in parallel in a direction separating from the center line CL1 in the main scanning direction SD11.

Referring to FIG. 5, the second inspection image 57 is symmetric with the second inspection image 56 with respect to the center line CL1.

Figure 7:
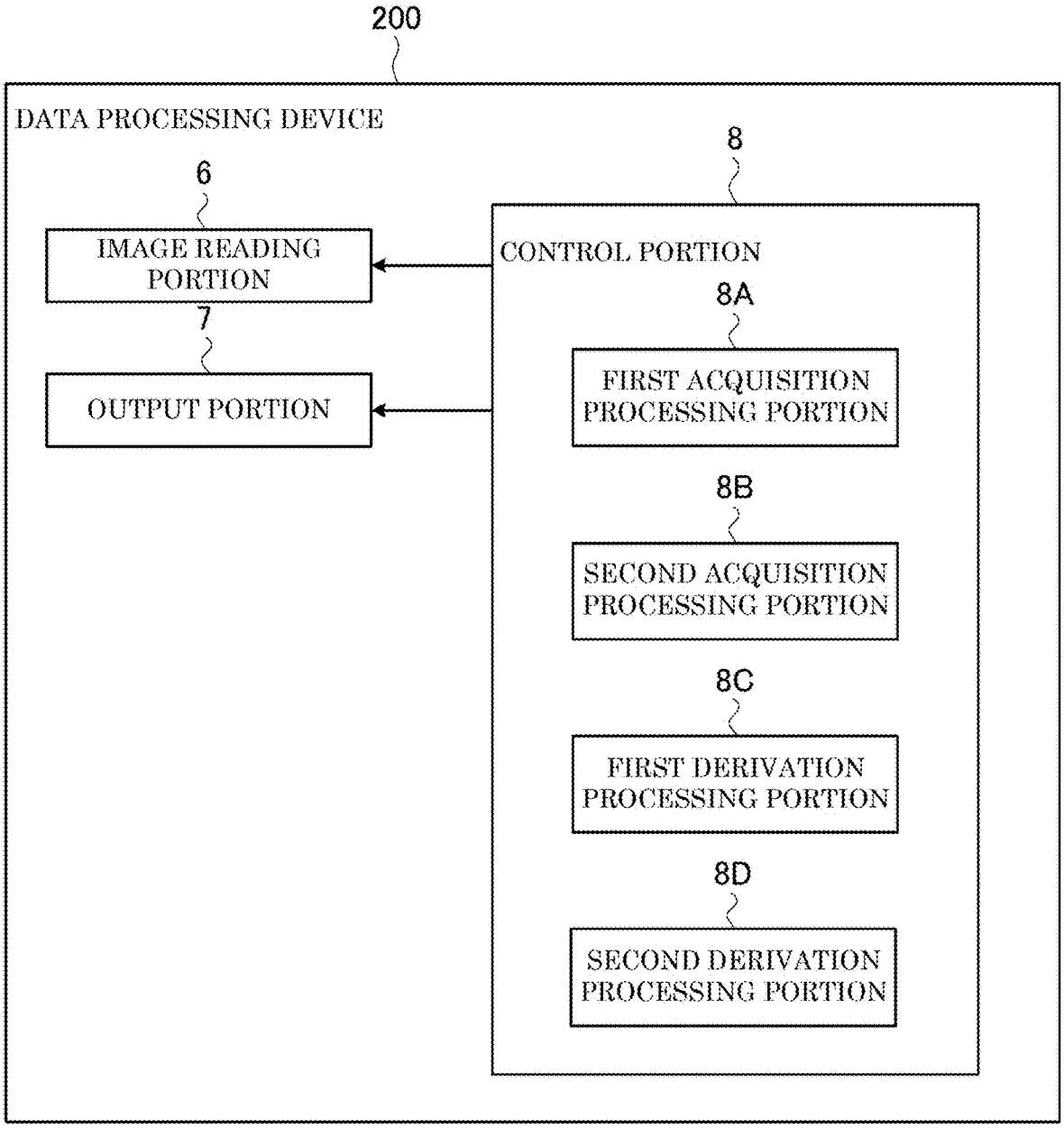
FIG. 7 is a block diagram showing a configuration of a data processing device according to the embodiment of the present disclosure.

Next, the data processing device 200 according to an embodiment of the present disclosure is described. Referring to FIG. 7, the data processing device 200 includes an image reading portion 6, an output portion 7, and a control portion 8.

The image reading portion 6 is, for example, a flat-bed scanner, and includes a contact portion and a carriage. The image reading portion 6 causes the carriage to optically read the specific print S11 that has been set on the contact portion by the user, and generates specific image data 58 that represents the specific color image 50 (see FIG. 5). The specific image data 58 includes a color value and a position of each of pixels that are aligned in the main scanning direction SD11 and the sub scanning direction SD12. The position of the pixel includes a position in the main scanning direction SD11 and a position in the sub scanning direction SD12.

The output portion 7 is, for example, a display device, and outputs various types of information transmitted by the control portion 8.

The control portion 8 includes: a processor that is a CPU or the like; a program storage portion that is a ROM or the like; and a working area that is a RAM or the like. The processor executes programs that are preliminarily stored in the program storage portion, by using the working area. This allows the control portion 8 to control the image reading portion 6 and the output portion 7 comprehensively. It is noted that the control portion 8 may be an electronic circuit such as an ASIC (Application Specific Integrated Circuit) or a DSP (Digital Signal Processor).

In addition, the control portion 8 includes, as a plurality of processing portions, a first acquisition processing portion 8A, a second acquisition processing portion 8B, a first derivation processing portion 8C, and a second derivation processing portion 8D. Specifically, the control portion 8 functions as the plurality of processing portions when the processor executes the programs.

The first acquisition processing portion 8A acquires, from specific areas SR11 and SR14 (see FIG. 5) that align in the sub scanning direction SD12 on the specific color image 50, a first position P101Y and a second position P201B (see FIG. 9) in the main scanning direction SD11, the first position P101Y and the second position P201B being positions of pixels of yellow and black formed on the image carriers 211 and 241 (see FIG. 2) that rotate with the rotation period.

The specific color image 50 is an example of a color image of the present disclosure. The specific area SR14 is an example of a first specific area of the present disclosure. The specific area SR11 is an example of a second specific area of the present disclosure. Yellow is an example of a first color of the present disclosure. Black is an example of a second color of the present disclosure. In addition, the image carrier 211 is an example of a first image carrier of the present disclosure, and the image carrier 241 is an example of a second image carrier of the present disclosure.

The second acquisition processing portion 8B acquires, from the specific area SR34 (see FIG. 10) having the second specific length SL2 (see FIG. 5) in the sub scanning direction SD12 on the specific color image 50, a plurality of third positions P301Y (see FIG. 10) of a plurality of yellow pixels in the main scanning direction SD11. It is noted that the specific area SR34 is an example of a third specific area of the present disclosure.

The first derivation processing portion 8C, based on the plurality of third positions P301Y, derives a first color shift amount AD1Y (see FIG. 8) that indicates an amount of shifting of a plurality of yellow pixels in the main scanning direction SD11 on the specific color image 50. The first color shift amount AD1Y indicates an amount of shifting of pixels of a color of the second inspection image 56 in the main scanning direction SD11 from positions of the pixels in the ideal state.

The second derivation processing portion 8D, based on the first position P101Y, the second position P201B, and the first color shift amount AD1Y, derives a second color shift amount AD2Y (see FIG. 8) that indicates an amount of shifting between yellow and black in the main scanning direction SD11 on the specific color image 50. Specifically, the second color shift amount AD2Y indicates an amount of shifting of yellow pixels from black pixels in the main scanning direction SD11.

Figure 10:
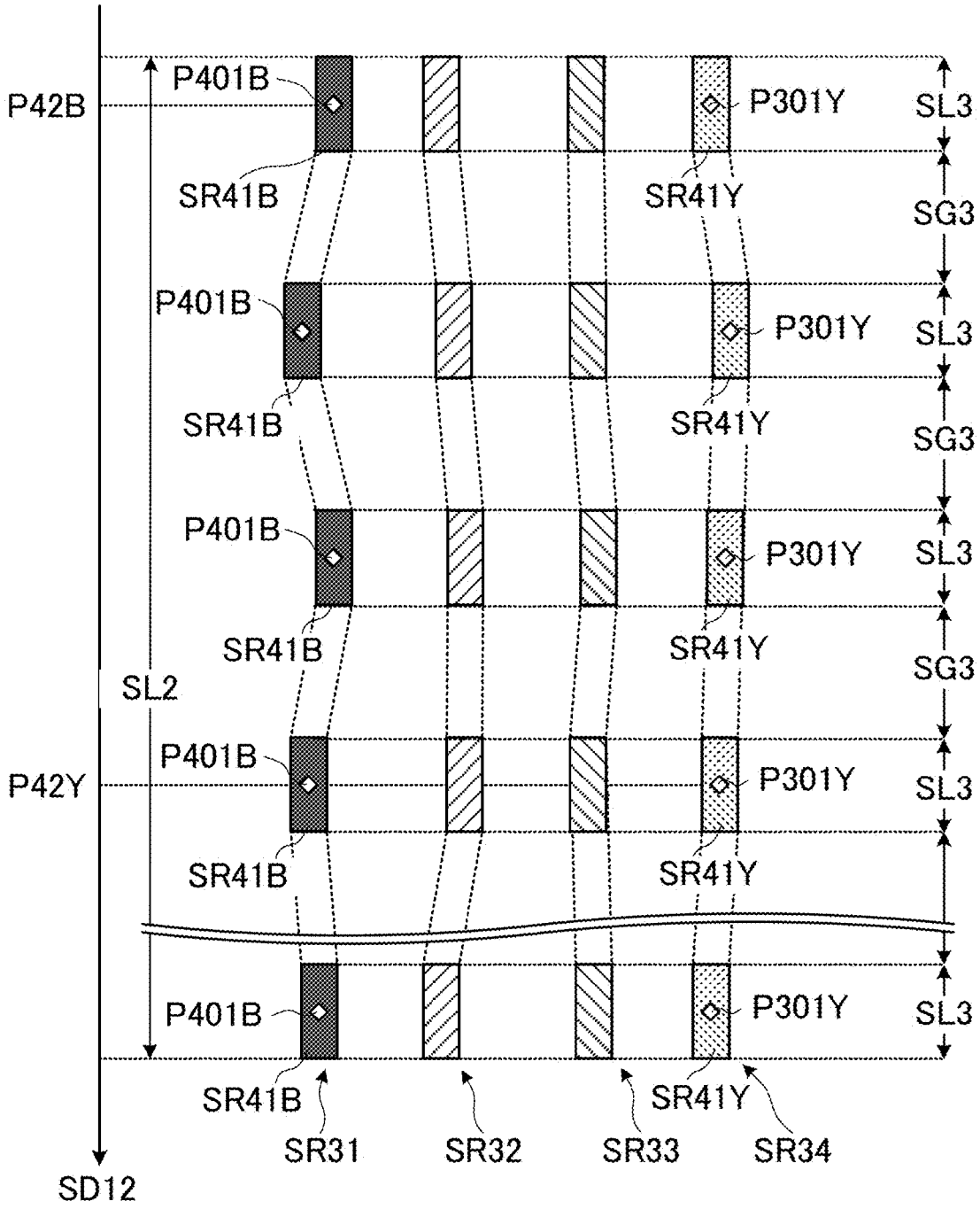
FIG. 10 is a schematic diagram showing a third position and a fourth position.

The first derivation processing portion 8C derives the first color shift amount AD1Y based on an intermediate position of two third positions P301Y at opposite ends in the main scanning direction SD11 among the plurality of third positions P301Y (see FIG. 10).

The second acquisition processing portion 8B further acquires a plurality of fourth positions P401B (see FIG. 10) of a plurality of black pixels in the main scanning direction SD11, from the specific area SR31 of the specific color image 50. The specific area SR31 is separated from the specific area SR34 in the main scanning direction SD11 on the specific color image 50, and has the second specific length SL2 in the sub scanning direction SD12.

The first derivation processing portion 8C, based on the plurality of fourth positions P401B, further derives a third color shift amount AD3B that indicates an amount of shifting of a plurality of black pixels in the main scanning direction SD11 in the specific area SR31. Specifically, the third color shift amount AD3B indicates an amount of shifting of black pixels in the main scanning direction SD11 in the specific area SR31 from positions of the pixels in the ideal state.

The second derivation processing portion 8D further derives the second color shift amount AD2Y based on the first position P101Y, the second position P201B, the first color shift amount AD1Y, and the third color shift amount AD3B.

Figure 11:
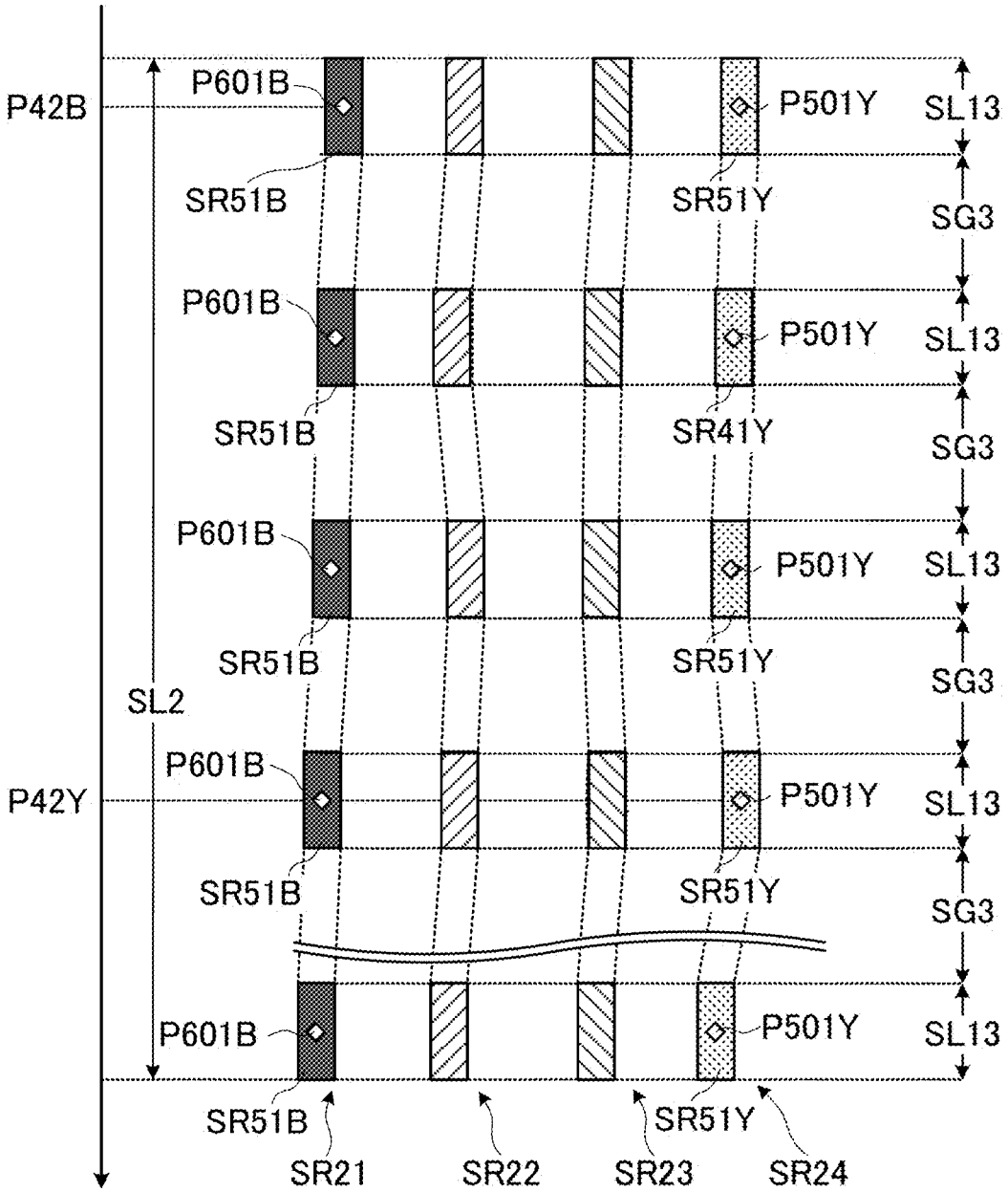
FIG. 11 is a schematic diagram showing a fifth position and a sixth position.

The second acquisition processing portion 8B further acquires a plurality of fifth positions P501Y (see FIG. 11) of a plurality of yellow pixels in the main scanning direction SD11, from the specific area SR24 (see FIG. 11). The specific area SR24 is preliminarily located at a position closer to a center of the specific color image 50 in the main scanning direction SD11 than the specific area SR34 (see FIG. 10), and has the second specific length SL2 in the main scanning direction SD11.

The first derivation processing portion 8C, based on the plurality of third positions P301Y and the plurality of fifth positions P501Y, derives the first color shift amount AD1Y that indicates an amount of shifting of a plurality of yellow pixels in the main scanning direction SD11 on the specific color image 50.

The second derivation processing portion 8D converts the first color shift amount AD1Y of the specific area SR34 to the first color shift amount AD1Y of the specific area SR14 based on the first position P101Y and the third position P301Y, and derives the second color shift amount AD2Y based on the converted first color shift amount AD1Y, the first position P101Y, and the second position P201Y.

The following describes the processes performed by the data processing device 200 in more detail with reference to FIG. 8 to FIG. 14. It is noted that in the following description, a process of deriving the second color shift amount AD2Y that indicates an amount of shifting of pixels of the yellow image 61Y (namely, the specific area SR14) from pixels of the black image 61B1 (namely, the specific area SR11), is described in detail.

Figure 8:
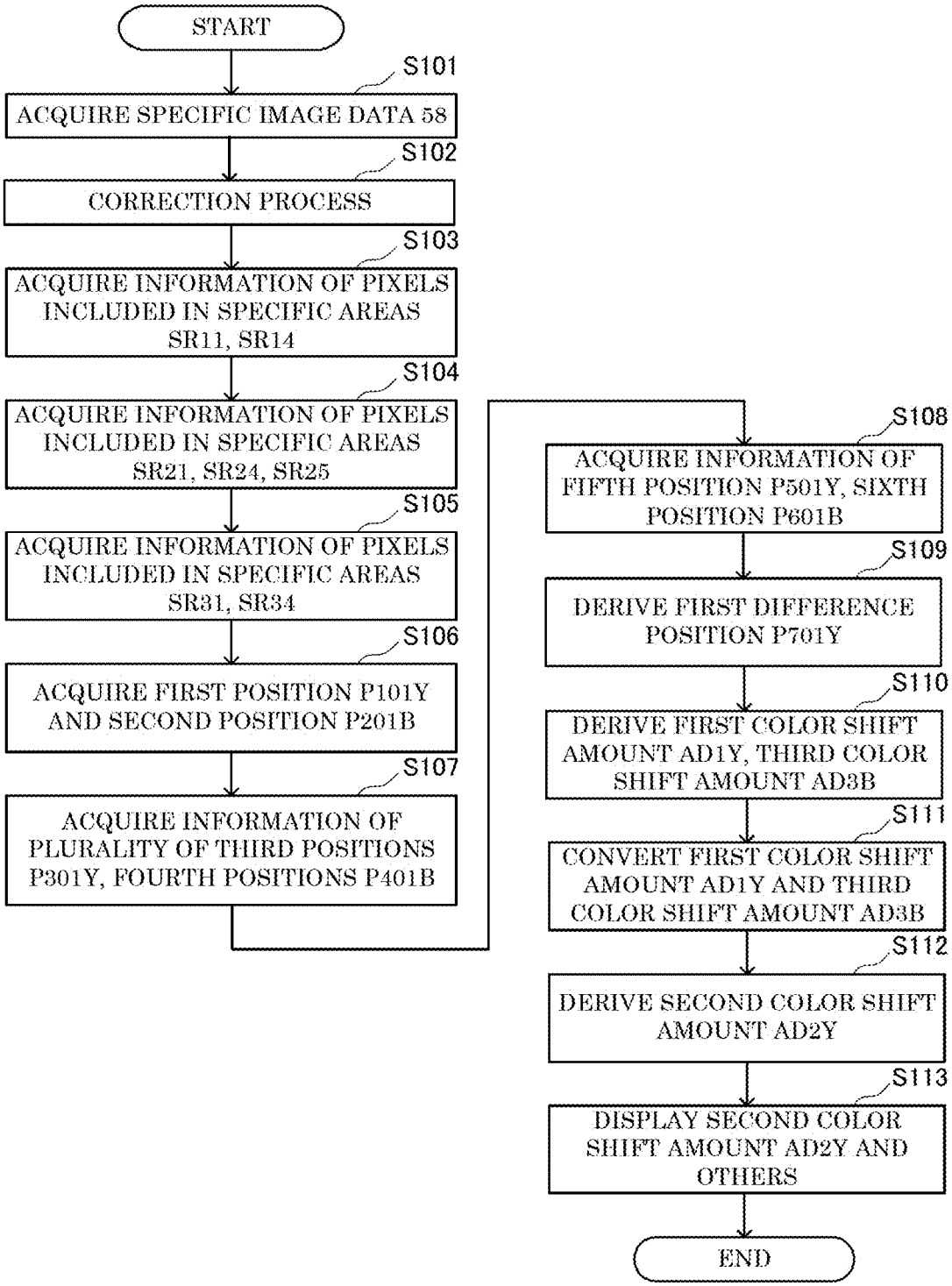
FIG. 8 is a flowchart showing a process performed by the data processing device shown in FIG. 7.

In step S101 of FIG. 8, the control portion 8 acquires the specific image data 58 from the image reading portion 6 and stores it in the RAM, wherein the specific image data 58 is generated by the image reading portion 6 by optically reading the specific print S11 set on the image reading portion 6 by a person in charge of the adjustment process (step S101). The specific image data 58 includes information of a color value and a position of each of pixels aligned in the main scanning direction SD11 and the sub scanning direction SD12. The position of each pixel is identified by a position in the main scanning direction SD11 and a position in the sub scanning direction SD12.

Subsequently, in step S102, the control portion 8 extracts, from the specific image data 58, information of pixels included in the specific areas SR11 and SR14 by performing a pattern recognition process or the like on the specific image data 58. Subsequently, in step S103, the control portion 8 extracts, from the specific image data 58, information of pixels included in the specific areas SR21, SR24, and SR25. Subsequently, in step S104, the control portion 8 extracts, from the specific image data 58, information of pixels included in the specific areas SR31 and SR34.

The specific print S11 may be set obliquely on the contact portion. As a result, the control portion 8 executes a correction process on the information of the pixels included in the specific areas SR11, SR14, SR21, SR24, SR31, and SR34 (step S105). Specifically, the control portion 8 derives a slanting degree of the line images 71 and 75 with respect to the sub scanning direction SD12 based on the information (especially, positions of the pixels) included in the specific areas SR21 and SR25. If the slanting degree is out of an allowable range, the control portion 8 corrects the position information of the pixels included in the specific areas SR11, SR14, SR21, SR24, SR31, and SR34 so that the slanting degree is within the allowable range. It is noted that the lens of the image reading portion 6 may have an optical distortion, or the specific print S11 may be deformed. In step S105, the distortion or the deformation may be corrected.

Subsequently, in step S106, the control portion 8 functions as the first acquisition processing portion 8A, and acquires the first position P101Y and the second position P201B (see FIG. 9).

Figure 9:
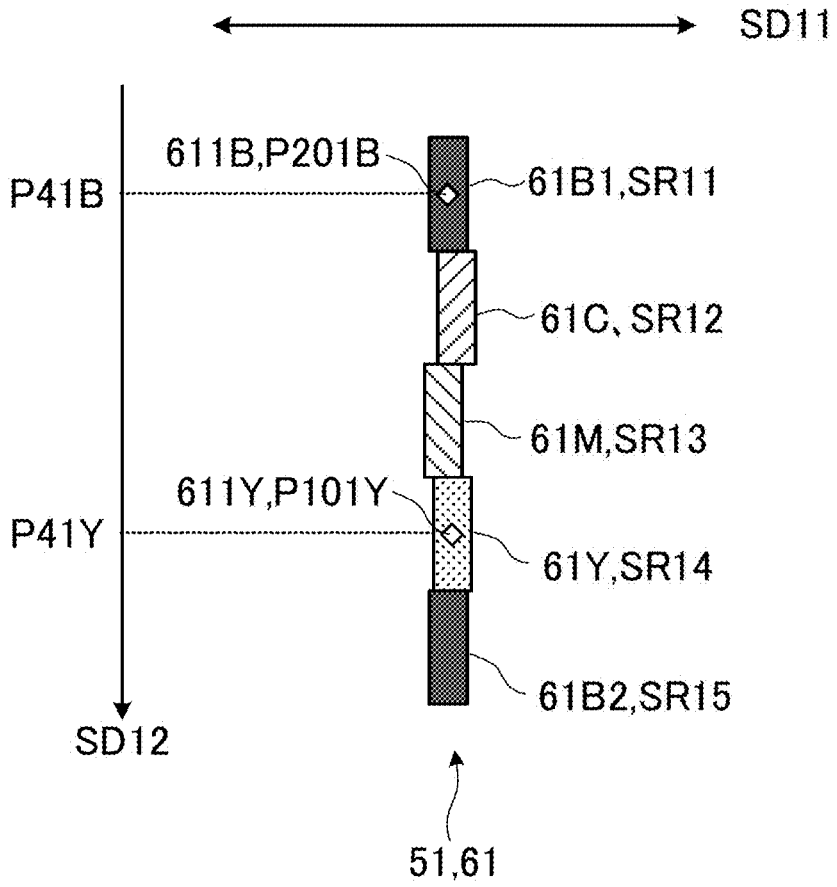
FIG. 9 is a schematic diagram showing a first position and a second position.

Specifically, in step S106, the first acquisition processing portion 8A acquires, as information of a yellow specific pixel 611Y, information of a pixel in the specific area SR14 that has a position P41Y in the sub scanning direction SD12 (see FIG. 9). Similarly, the first acquisition processing portion 8A acquires, as information of a specific pixel 611B, information of a pixel in the specific area SR11 that has a position P41B in the sub scanning direction SD12 (see FIG. 9). The positions P41Y and P41B are predetermined. In addition, the information of the specific pixels 611Y and 611B includes the first position P101Y and the second position P201B in the main scanning direction SD11.

Subsequently, in step S107, the control portion 8 functions as the second acquisition processing portion 8B, and acquires information of a plurality of third positions P301Y and fourth positions P401B (see FIG. 10).

Specifically, in step S107, the second acquisition processing portion 8B acquires information included in a plurality of partial specific areas SR41B and SR41Y (see FIG. 10) of the specific areas SR31 and SR34. Each of the plurality of partial specific areas SR41B is a linear area included in the specific area SR31 and has a third specific length SL13 in the sub scanning direction SD12. The plurality of partial specific areas SR41B are aligned in the sub scanning direction SD12 with specific intervals SG3 therebetween. A partial specific area SR41B located on the most upstream side in the sub scanning direction SD12 has a position P42B that is separated from the position P41B by the first specific length SL1. Each of the plurality of partial specific areas SR41Y is a linear area included in the specific area SR34 and has the third specific length SL13 in the sub scanning direction SD12. The plurality of partial specific areas SR41Y are aligned in the sub scanning direction SD12 with specific intervals SG3 therebetween. The 4th partial specific area SR41Y from the most upstream side in the sub scanning direction SD12 has a position P42Y that is separated from the position P41Y by the first specific length SL1.

In step S107, the second acquisition processing portion 8B further acquires a plurality of third positions P301Y for yellow and a plurality of fourth positions P401B for black from information of pixels included in the partial specific areas SR41Y and SR41B. As shown in FIG. 10, the plurality of third positions P301Y and fourth positions P401B are, for example, positions in the main scanning direction SD11 of pixels located at the centers of corresponding partial specific areas SR41C, SR41M, SR41Y, and SR41B.

Subsequently, in step S108, the control portion 8 functions as the second acquisition processing portion 8B, and executes an acquisition process to acquire information of a fifth position P501Y and a sixth position P601B (see FIG. 11).

Specifically, in step S108, the second acquisition processing portion 8B acquires information included in a plurality of partial specific areas SR51B and SR51Y (see FIG. 11). Each of the plurality of partial specific areas SR51B and SR51Y is a linear area included in the specific areas SR21 and SR24 and has the third specific length SL13 in the sub scanning direction SD12. The plurality of partial specific areas SR51B and SR51Y are aligned in the sub scanning direction SD12 with the specific intervals SG3 therebetween.

In step S108, the second acquisition processing portion 8B further acquires, as a plurality of fifth positions P501Y and a plurality of sixth positions P601B, positions in the main scanning direction SD11 of pixels located at the centers or the like of partial specific areas SR51Y and SR51B.

Figure 12:
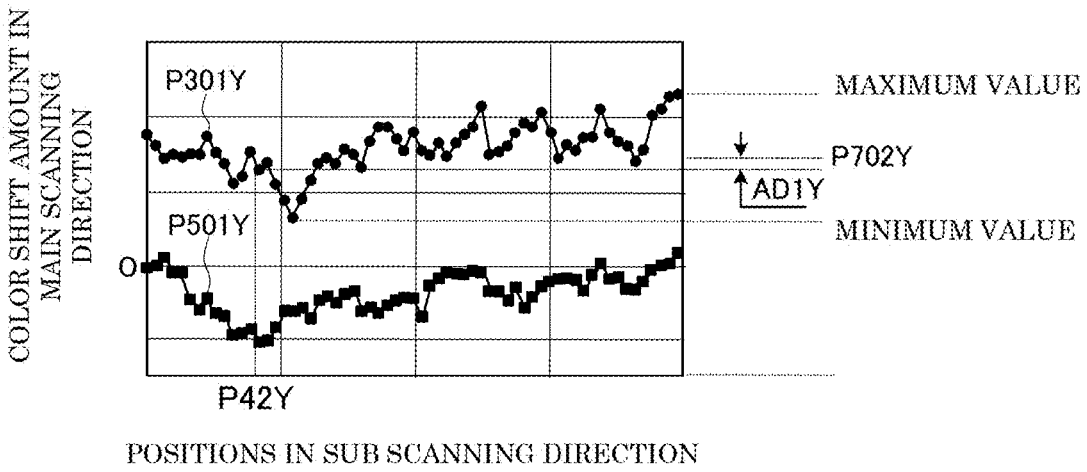
FIG. 12 is a graph showing third positions plotted versus positions in a sub scanning direction.

In the ideal state, the plurality of third positions P301Y do not vary at positions in the sub scanning direction SD12. However, due to the distance variation, the plurality of third positions P301Y include shifts at positions in the sub scanning direction SD12 with respect to the original pixel position, as plotted by the black solid circles in FIG. 12. In other words, FIG. 12 shows color shift amounts at the plurality of third positions P301Y with respect to the original pixel position. It is noted that in FIG. 12, the original pixel position is indicated as zero. In addition, as plotted by the black solid squares in FIG. 12, the plurality of fifth positions P501Y include shifts at positions in the sub scanning direction SD12 with respect to the original pixel position. In addition, an amount of the rotational deviation of the image carrier 211 is larger at end portions than at the center in the main scanning direction SD11. As a result, there is a tendency that color shift amounts at the plurality of fifth positions P501Y vary more than color shift amounts at the plurality of third positions P301Y, at positions close to the original pixel position (namely, zero position).

Subsequently, in step S109 of FIG. 8, the control portion 8 functions as the second acquisition processing portion 8B. The second acquisition processing portion 8B selects a plurality of pairs of third position P301Y and fifth position P501Y that are at the same position in the sub scanning direction SD12, from information of a plurality of third positions P301Y and a plurality of fifth positions P501Y. The second acquisition processing portion 8B derives a first difference position P701Y for each of the selected plurality of pairs of third position P301Y and fifth position P501Y, wherein the first difference position P701Y indicates a difference between the third position P301Y and the fifth position P501Y. As plotted by the black solid triangles in FIG. 13, the plurality of first difference positions P701Y vary at positions in the sub scanning direction SD12.

Subsequently, in step S110 of FIG. 8, the control portion 8 functions as the first derivation processing portion 8C, and derives the first color shift amount AD1Y and the third color shift amount AD3B.

Figure 13:
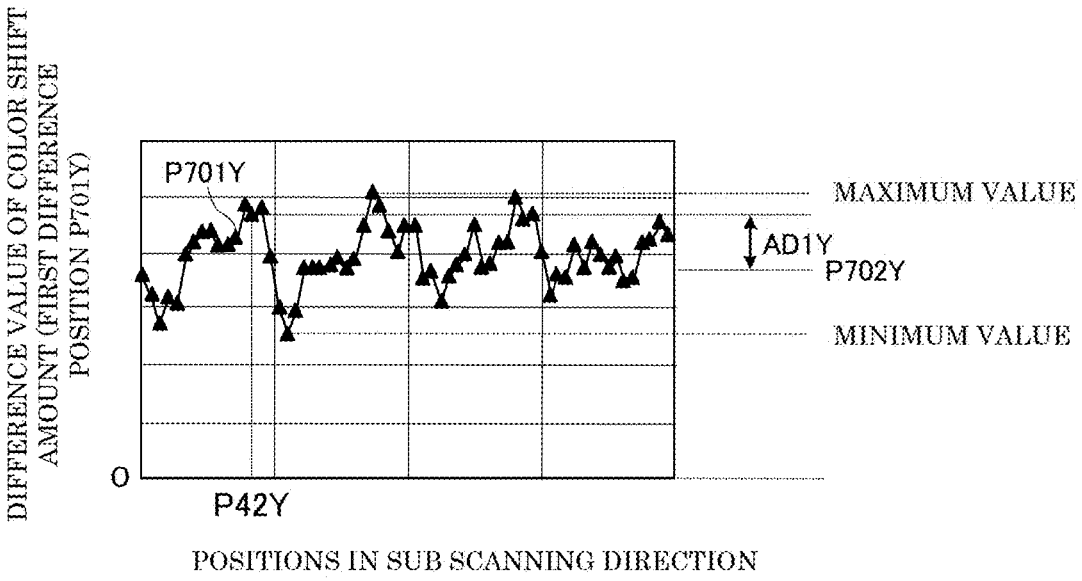
FIG. 13 is a graph showing first difference positions plotted versus positions in the sub scanning direction.

Specifically, in step S110, the first derivation processing portion 8C derives an intermediate difference position P702Y between two first difference positions P701Y (in FIG. 13, "maximum value" and "minimum value") that are located at opposite ends in the main scanning direction SD11 (see FIG. 13).

In step S110, the first derivation processing portion 8C further acquires a first difference position P701Y that corresponds to a position P42Y in the sub scanning direction SD12. Subsequently, the first derivation processing portion 8C derives, as the first color shift amount AD1Y for the original position of the third position P301Y, a difference value between: the first difference position P701Y corresponding to the position P42Y; and the intermediate difference position P702Y. Similarly, the first derivation processing portion 8C derives, as the third color shift amount AD3B, a difference value between: an intermediate difference position P702B between two first difference positions P701B located at opposite ends in the main scanning direction SD11; and a first difference position P701B corresponding to a position P42B.

It is noted that in step S110, the first derivation processing portion 8C may derive an intermediate position P801Y between third positions P301Y at opposite ends in the main scanning direction SD11 (see FIG. 12). In this case, the first derivation processing portion 8C may derive, as another example of the first color shift amount AD1Y: a difference value between the third position P301Y corresponding to the position P42Y in the sub scanning direction SD12; and the intermediate difference position P801Y. In this case, the first derivation processing portion 8C derives, in a similar manner, the third color shift amount AD3B.

Figure 14:
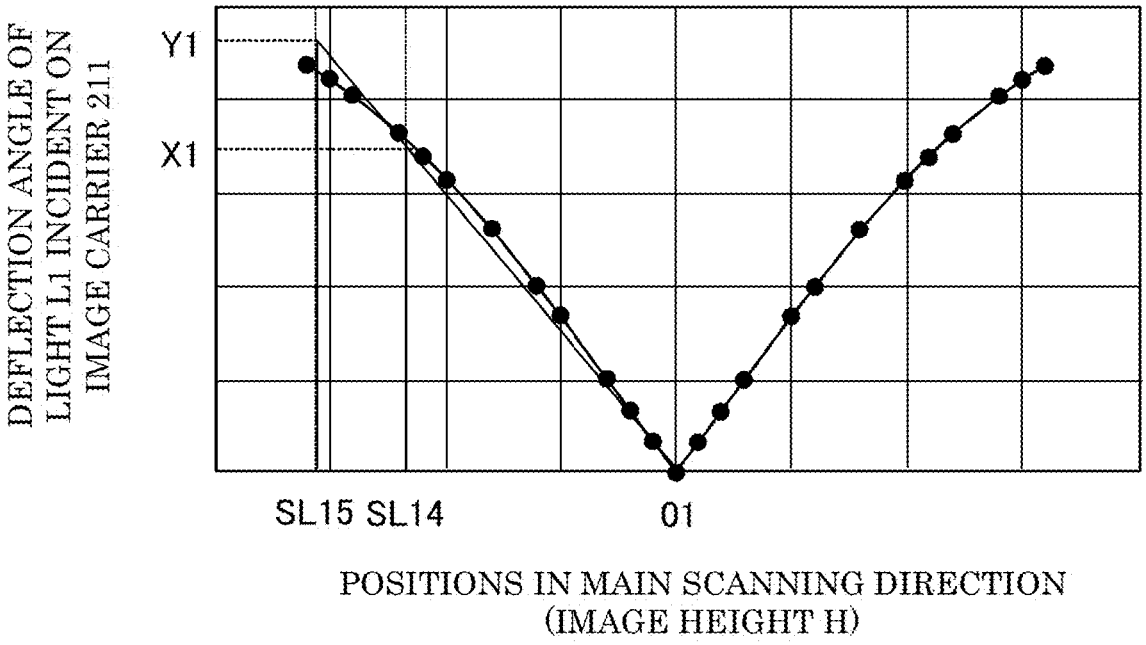
FIG. 14 is a diagram showing content of a conversion process shown in FIG. 8.

As shown in FIG. 5 and FIG. 6, in the specific color image 50, the line image 61 and the second inspection image 56 are formed at different positions in the main scanning direction SD11. As a result, the first color shift amount AD1Y that is derived based on the third positions P301Y does not correspond to the first position P101Y. Similarly, the third color shift amount AD3B that is derived based on the fourth positions P401B does not correspond to the second position P201B. In addition, as shown in FIG. 14, deflection angle θ1 of light L1 that is incident on the image carrier 211 increases approximately linearly as the image height H increases.

In step S111 of FIG. 8, the control portion 8 functions as the second derivation processing portion 8D, and converts the first color shift amount AD1Y that has been derived based on the third positions P301Y, to the first color shift amount AD1Y that corresponds to the first position P101Y. In addition, the control portion 8 converts the third color shift amount AD3B that has been derived based on the fourth positions P401B, to the third color shift amount AD3B that corresponds to the second position P201B.

Specifically, the second derivation processing portion 8D derives: a third position P301Y that, in the line image 84, corresponds to the position P42Y (see FIG. 10); and distances SL14 and SL15 (see FIG. 14) between the center line CL1 and the position P41Y (see FIG. 9) in the yellow image 61Y. Here, the third color shift amount AD3B after conversion is assumed to be Y, and the third color shift amount AD3B before conversion is assumed to be X. Under the assumption, the second derivation processing portion 8D derives the first color shift amount AD1Y based on the first position P101Y by calculating Y=X×SL15/SL14. The second derivation processing portion 8D corrects the first position P101Y by adding the first color shift amount AD1Y after conversion to the first position P101Y. Similarly, the third color shift amount AD3B based on the fourth positions P401B is converted to the third color shift amount AD3B corresponding to the second position P201B. Thereafter, the third color shift amount AD3B after conversion is added to the second position P201B, for the second position P201B to be corrected.

Subsequently, in step S112 of FIG. 8, the control portion 8 functions as the second derivation processing portion 8D. The second derivation processing portion 8D derives the second color shift amount AD2Y for yellow by subtracting the second position P201B after correction from the first position P101Y after correction.

The processes of steps S102 to S112 are executed, in a similar manner, on the magenta image 61M and the cyan image 61C, and second color shift amounts AD2M and AD2C are derived, wherein the second color shift amounts AD2M and AD2C respectively indicate amounts by which pixels of the magenta image 61M and the cyan image 61C (namely, specific areas SR13 and SR12) are shifted with respect to pixels of the black image 61B1 (namely, specific area SR11). In addition, the processes of steps S102 to S112 are executed, in a similar manner, on the other first inspection images 52 to 54.

Subsequently, in step S113, the control portion 8 displays, on the output portion 7, the second color shift amount AD2Y for yellow, the second color shift amount AD2M for magenta, and the second color shift amount AD2C for cyan. An inspector of the shift inspection adjusts, for example, the timings at which the image forming portion 2 forms yellow, magenta, and cyan toner images, so that the second color shift amounts AD2Y, AD2M, and AD2C are eliminated.

In the present embodiment, the first color shift amount AD1Y is derived based on the specific areas SR24 and SR34 having the second specific length SL2 that is larger than the first specific length SL1 that corresponds to the rotation period of the image carrier 211. The positions in the main scanning direction SD11 of the pixels included in the specific areas SR24 and SR34 include an amount of variation of a distance between the LSU 25 and the image carrier 211 over the whole region of the image carrier 211 in the rotation direction RD11. As a result, the first color shift amount AD1Y based on the specific area SR24 indicates a more accurate shift amount than a color shift amount based on a specific pattern having a length that is smaller than the first specific length SL1. For similar reasons, the first color shift amounts AD1M and AD1C and the third color shift amount AD3B also indicate accurate shift amounts. In the present embodiment, the second color shift amounts AD2Y, AD2M, and AD2C are derived based on the first color shift amounts AD1Y, AD1M, and AD1C, and the third color shift amount AD3B. In the image forming apparatus 100, timings at which yellow, magenta, and cyan toner images are formed are adjusted based on the second color shift amounts AD2Y, AD2M, and AD2C. Accordingly, in an image formation performed by the image forming apparatus 100 after shipping, it is possible to reduce the shift in the main scanning direction SD11 between toner images of a plurality of colors in a case where the toner images are overlaid on the intermediate transfer belt 271.

The present embodiment describes an example in which the control portion 8 includes the plurality of processing portions (namely, the first acquisition processing portion 8A, the second acquisition processing portion 8B, the first derivation processing portion 8C, and the second derivation processing portion 8D). However, not limited to this configuration, the control portion 4 may include the plurality of processing portions. In this case, the control portion 4 is configured to acquire the specific image data 58 from an image reading device included in the image forming apparatus 100.

In addition, the present embodiment describes an example in which the specific image data 58 represents the specific color image 50 transferred to the sheet S10. However, not limited to this configuration, the specific image data 58 may represent the specific color image 50 transferred to the intermediate transfer belt 271. In this case, the image reading portion 6 reads the specific color image 50 at a position that is separated toward the downstream in the rotation direction RD12, from all the primary transfer positions TP11 by a specific distance.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A data processing device comprising:

a first acquisition processing portion configured to acquire, respectively from a first specific area and a second specific area that align in a sub scanning direction on a color image that is formed based on image data, a first position and a second position in a main scanning direction, the first position and the second position being respectively positions of pixels of a first color and a second color formed on a plurality of image carriers that rotate;

a second acquisition processing portion configured to acquire, from a third specific area having a second specific length in the sub scanning direction on the color image, a plurality of third positions of a plurality of pixels of the first color in the main scanning direction, the second specific length being larger than a first specific length that is a length in a peripheral direction of each of the image carriers;

a first derivation processing portion configured to, based on the plurality of third positions, derive a first color shift amount that indicates an amount of shifting of pixels of the first color in the main scanning direction in the third specific area; and a second derivation processing portion configured to, based on the first position, the second position, and the first color shift amount, derive a second color shift amount that indicates an amount of shifting between the first color and the second color in the main scanning direction in the first specific area.

2. The data processing device according to claim 1, wherein the first derivation processing portion derives the first color shift amount based on an intermediate position of two third positions at opposite ends in the main scanning direction among the plurality of third positions.

3. The data processing device according to claim 1, wherein the second acquisition processing portion further acquires a plurality of fourth positions of a plurality of pixels of the second color in the main scanning direction, from a fourth specific area of the color image, the fourth specific area being separated from the third specific area in the main scanning direction on the color image and having the second specific length in the sub scanning direction, the first derivation processing portion, based on the plurality of fourth positions, further derives a third color shift amount that indicates an amount of shifting of a plurality of pixels of the second color in the main scanning direction in the fourth specific area, and the second derivation processing portion further derives the second color shift amount based on the first position, the second position, the first color shift amount, and the third color shift amount.

4. The data processing device according to claim 1, wherein the second acquisition processing portion further acquires a plurality of fifth positions of a plurality of pixels of the first color in the main scanning direction, from a fifth specific area of the color image, the fifth specific area being preliminarily located at a position closer to a center of the color image in the main scanning direction than the third specific area and having the second specific length in the sub scanning direction, the first derivation processing portion, based on the plurality of third positions and the plurality of fifth positions, derives the first color shift amount that indicates an amount of shifting of a plurality of pixels of the first color in the main scanning direction in the third specific area.

5. The data processing device according to claim 1, wherein the second derivation processing portion converts the first color shift amount of the third specific area to the first color shift amount of the first specific area based on the first position and the third position, and derives the second color shift amount based on the converted first color shift amount, the first position, and the second position.

6. An image forming apparatus comprising:

the data processing device according to claim 1; and an image forming portion configured to form an image on a sheet.

* * * * *